United States Patent [19]

Ampferer

[11] Patent Number: 5,063,895

[45] Date of Patent: Nov. 12, 1991

[54] OIL PUMP DRIVE ARRANGEMENT FOR A PISTON INTERNAL-COMBUSTION ENGINE AND METHOD OF MAKING SAME

[75] Inventor: Herbert Ampferer, Sachsenheim, Fed. Rep. of Germany

[73] Assignee: Dr. Ing. h.c.F. Porsche AG, Fed. Rep. of Germany

[21] Appl. No.: 598,150

[22] Filed: Oct. 16, 1990

Related U.S. Application Data

[63] Continuation-in-part of Ser. No. 546,882, Jul. 2, 1990, abandoned.

[30] Foreign Application Priority Data

Jul. 1, 1989 [DE] Fed. Rep. of Germany ..... 3921715

[51] Int. Cl.[5] ..... F01M 1/02

[52] U.S. Cl. ..... 123/196 R; 123/90.15; 123/198 C

[58] Field of Search ..... 123/196 R, 198 C, 90.15, 123/90.18, 90.16, 90.17; 418/171

[56] References Cited

U.S. PATENT DOCUMENTS

| | | | |
|---|---|---|---|
| 3,159,047 | 12/1964 | Dable | 74/450 |
| 4,589,382 | 5/1986 | Tsuboi | 123/196 R |
| 4,864,988 | 9/1989 | Mezger | 123/196 R |
| 4,878,461 | 11/1989 | Sapienza, IV | 123/90.15 |

FOREIGN PATENT DOCUMENTS

| | | |
|---|---|---|
| 0163046 | 12/1985 | European Pat. Off. . |
| 0272677 | 6/1988 | European Pat. Off. . |
| 2620480 | 11/1977 | Fed. Rep. of Germany . |
| 3619577 | 12/1987 | Fed. Rep. of Germany . |

*Primary Examiner*—E. Rollins Cross
*Assistant Examiner*—Erick Solis
*Attorney, Agent, or Firm*—Evenson, Wands, Edwards, Lenahan & McKeown

[57] ABSTRACT

The lubricating-oil circulating system of a piston internal-combustion engine is supplied by a main oil pump arranged in the oil pan and driven by the crankshaft. A second oil pump, which is also driven by the crankshaft, supplies hydraulic pressure to hydraulic camshaft rotating devices. The second oil pump is integrated in an intermediate timing gear and is driven by it, the camshafts being driven by the crankshaft by way of this intermediate timing gear.

18 Claims, 4 Drawing Sheets

OIL PUMP DRIVE ARRANGEMENT FOR A PISTON INTERNAL-COMBUSTION ENGINE AND METHOD OF MAKING SAME

BACKGROUND AND SUMMARY OF THE INVENTION

This application is a Continuation-In-Part of my copending application Ser. No. 07/546,882, filed on July 2, 1990, now abandoned.

The invention relates to an arrangement for driving two oil pumps arranged on a piston internal-combustion engine of the type having a main oil pump for supplying the engine lubricating-oil circulating system of the internal-combustion engine and a second oil pump, valves of the internal-combustion engine being actuated by camshafts which are driven by a crankshaft.

From the German Patent Document DE-OS 26 20 480, a lubricating-oil supply system for an internal-combustion engine is known which comprises a main oil pump for supplying a main lubricating-oil circulating system and a second oil pump for an auxiliary lubricating-oil circulating system of auxiliary machines.

In the EP-PS 163 046, a hydraulic arrangement is described for the angular adjustment of two camshafts in which an oil pump supplies the hydraulic pressure for the cam rotating device and at the same time supplies the bearings of the camshaft with lubricating oil.

It is an object of the invention to arrange and drive two oil pumps on a piston internal-combustion engine in such a manner that an optimum lubrication and camshaft adjustment and, at the same time, a compact space-saving construction is made possible.

This object is achieved by providing an arrangement wherein the second oil pump supplies only hydraulic pressure to a hydraulic camshaft rotating device, wherein the main oil pump and the second oil pump are driven by means of respective separate main and second drive by the crankshaft disposed at the crankcase, and wherein the main and second drives are situated at the same axial location of the crankshaft as a camshaft drive originating from the crankshaft. Since, for the driving of both oil pumps from the direction of the crankshaft, two separate drives are used and for a separation of functions, one oil pump is used for the lubricating-oil supply and the other oil pump is used exclusively to build up the hydraulic pressure at the camshaft rotating device, both oil pumps may be designed in an optimal manner with respect to the delivery volume and the delivery pressure. While the main oil pump for the lubricating-oil supply delivers relatively large amounts of oil at a low pressure, the second oil pump is designed in such a manner that it delivers a smaller amount at a significantly higher pressure.

A space-saving construction is implemented in that the drives of both pumps are disposed at the point of the crankshaft from where the camshaft drive also takes place so that no additional space is required for the drives of the oil pumps in the axial direction of the internal-combustion engine. This space is fully utilized if the main oil pump is disposed below the crankshaft and the second oil pump and its drive, together with the camshaft drive, are disposed above the crankshaft.

Another space advantage can be achieved in certain preferred embodiment by providing that the second oil pump is integrated in an intermediate timing gear of the camshaft drive and, being disposed coaxially with respect to the intermediate timing gear, is driven by it.

Reference is also made to related, commonly assigned U.S patent application Ser. No. 07/546,881, filed July 2, 1990, based on German application P 39 21 717.7, filed July 1, 1989.

Other objects, advantages and novel features of the present invention will become apparent from the following detailed description of the invention when considered in conjunction with the accompanying drawings.

DETAILED DESCRIPTION OF THE DRAWINGS

Figure 1:
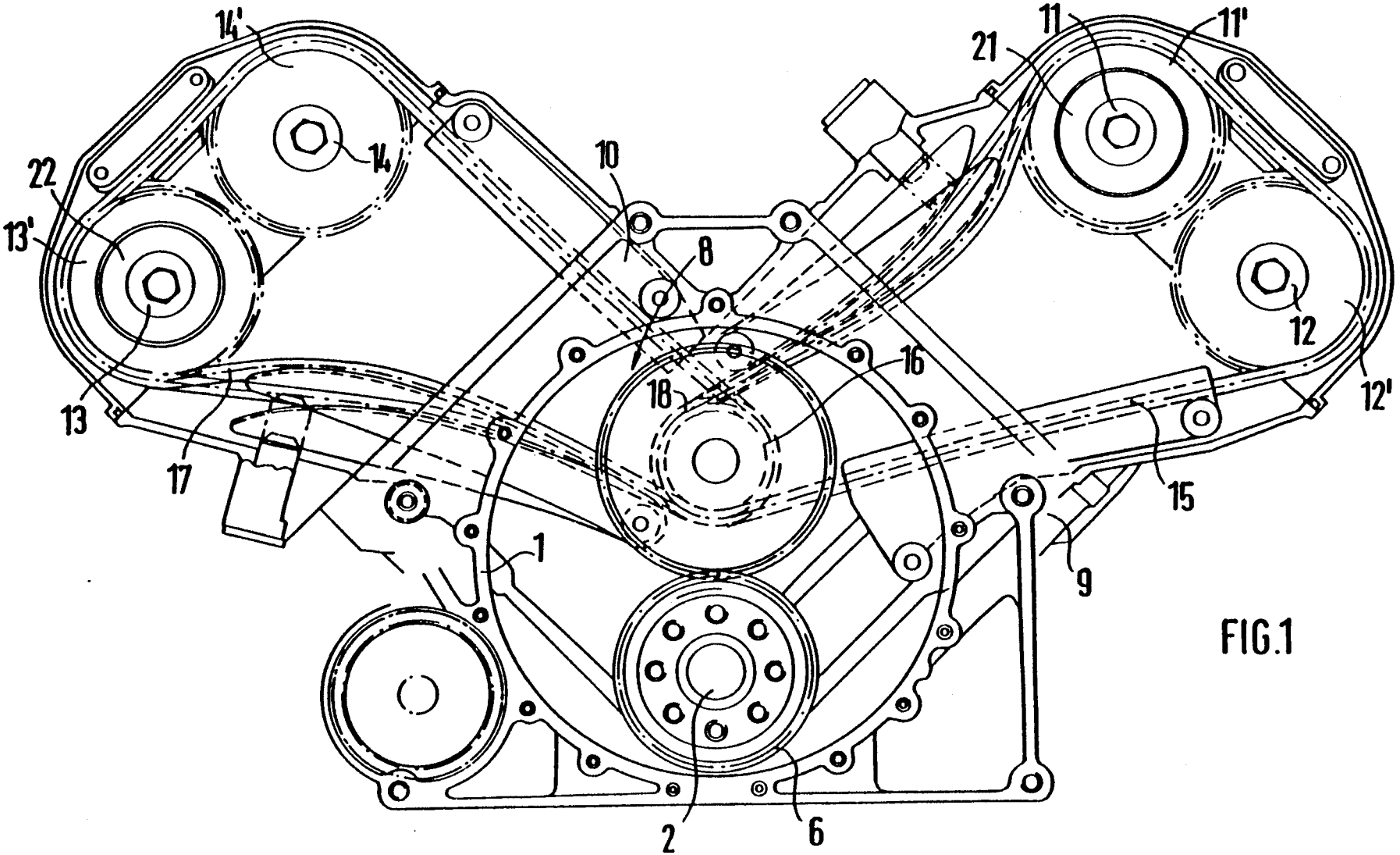
FIG. 1 is a schematic cross-sectional view of a piston internal-combustion engine having a camshaft drive, constructed according to a preferred embodiment of the invention.
Figure 2:
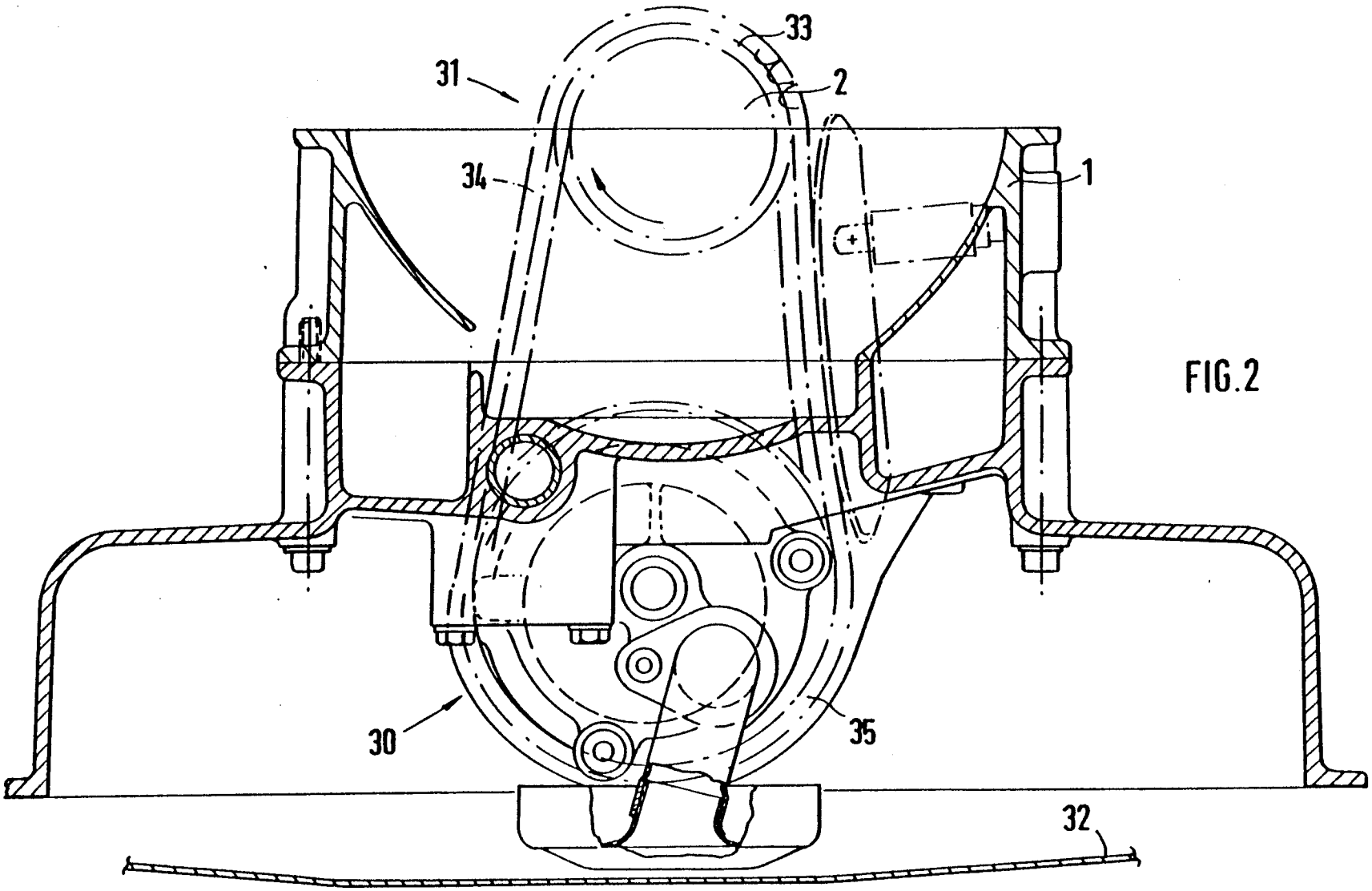
FIG. 2 is a schematic sectional view of an oil pump drive of a piston internal-combustion engine constructed according to FIG. 1.
Figure 3:
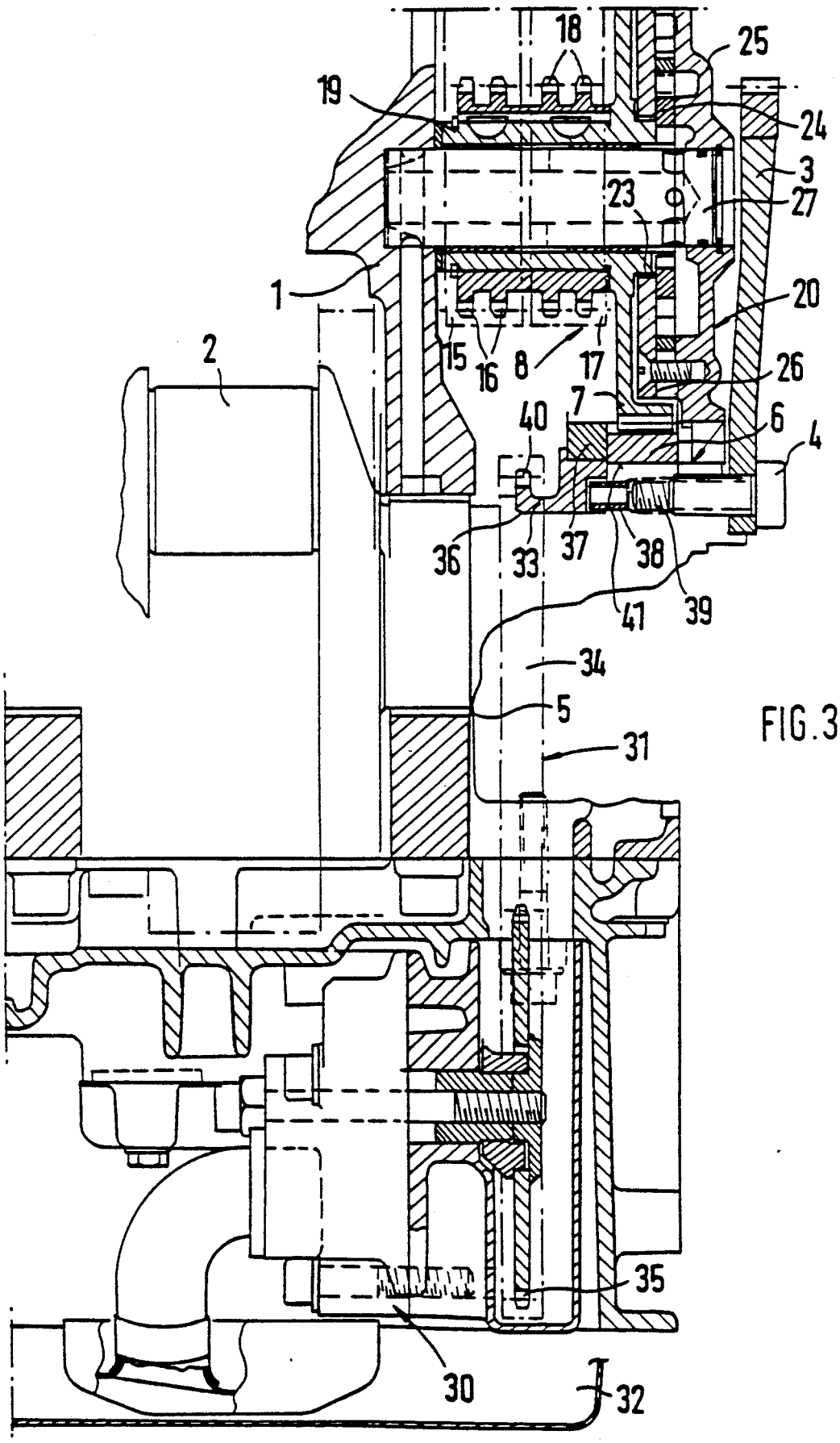
FIG. 3 is a longitudinal sectional view of the camshaft drive and oil pump drive according to FIGS. 1 and FIG. 2.

On a crankshaft 2 of an 8-cylinder V-engine disposed in a crankcase 1, a flywheel 3 is bolted to the output end face by means of several bolts 4. A camshaft drive originating from the crankshaft 2 is arranged between the flywheel 3 and the end bearing 5. The camshaft drive comprises a gear wheel 7 of an intermediate timing gear 8 mating with a crankshaft gear wheel 6 and two chain drives driven by the intermediate timing gear 8 and leading to the four camshafts 11, 12, 13, 14 assigned to the two cylinder banks 9, 10 and each carrying one double sprocket wheel 11', 12', 13', 14'. Double sprocket wheels 11', 12' are driven by a double sprocket wheel 16 by means of a double roller chain 15, and double sprocket wheels 13', 14' are driven by a double sprocket wheel 18 by means of a double roller chain 17. The double sprocket wheels 16, 18 are constructed in one piece and are fastened on the hub sleeve 19 of the gear wheel 7.

At the other end face of the gear wheel 7, an oil pump 20 is arranged which supplies hydraulic rotating devices 21, 22 at the camshafts 11, 13 with hydraulic pressure. By means of the rotating devices, the rotating position is changed between the camshafts 11, 13 and the sprocket wheels 11', 13' assigned to them. A pump wheel 24 is fastened on a hollow hub 23 of the gear wheel 7. The oil pump 20 is covered by means of a pump cover 25 which, together with a cover disk 26 screwed to it, forms the pump housing. In the pump cover 25, a bearing sleeve 27 is fastened on which the intermediate timing gear 8 is disposed and through which the oil supply takes place to the oil pump 20.

Since the gear wheel transmission from the crankshaft 2 to the intermediate timing gear 8 has a ratio of 1:2, but the chain sprocket transmission from the intermediate timing gear 8 to the camshafts 11, 12, 13, 14 is 1:1, the camshafts 11, 12, 13, 14 rotate at half the crankshaft speed.

The main oil pump 30 is driven by the crankshaft 2 by means of a chain drive 31. It takes in lubricating oil from the oil pan 32 and, with a pressure of approximately 3 bar, pumps it to the bearing points of the internal-combustion engine to be lubricated. A partial flow of this oil, by way of the central bore of the bearing sleeve 27, reaches the oil pump 20 which increases the oil pressure to approximately 8 bar and feeds it to the hydraulic camshaft rotating devices 21. Since this hydraulic pressure is very high, the camshaft rotating devices 21 may be constructed with a desirably small volume.

The chain drive 31 is formed by a sprocket wheel 33 fastened on the crankshaft 2, a chain 34, and a sprocket wheel 35 fastened to the main oil pump 30. The sprocket wheel 35 is comprised of two half shells which were formed by the radial separation of a cylindrical sprocket wheel hub. In a groove 36 of the crankshaft 2, the two half shells of the sprocket wheel 35 are joined again at their breaking point and are held axially. A retaining ring 37 pulled onto the sprocket wheel 35 holds the two half shells radially together. The sprocket wheel 33 is locked in the circumferential direction by means of a fitting sleeve 38 which is fixed in the crankshaft 2 and which, during the mounting, was fitted through a bore 39 of the flywheel which is aligned with it. The gear ring 40 of the sprocket wheel 33 and thus the whole chain drive 31 is disposed in the center between the two double sprocket wheels 16, 18 of the camshaft drive.

For the mounting, the crankshaft gear wheel 6 is pushed over the smoothly turned surface area 41 of the crankshaft 2 until it rests against the retaining ring 37. At this seat, it is shrunk onto the crankshaft 2.

Figure 4:
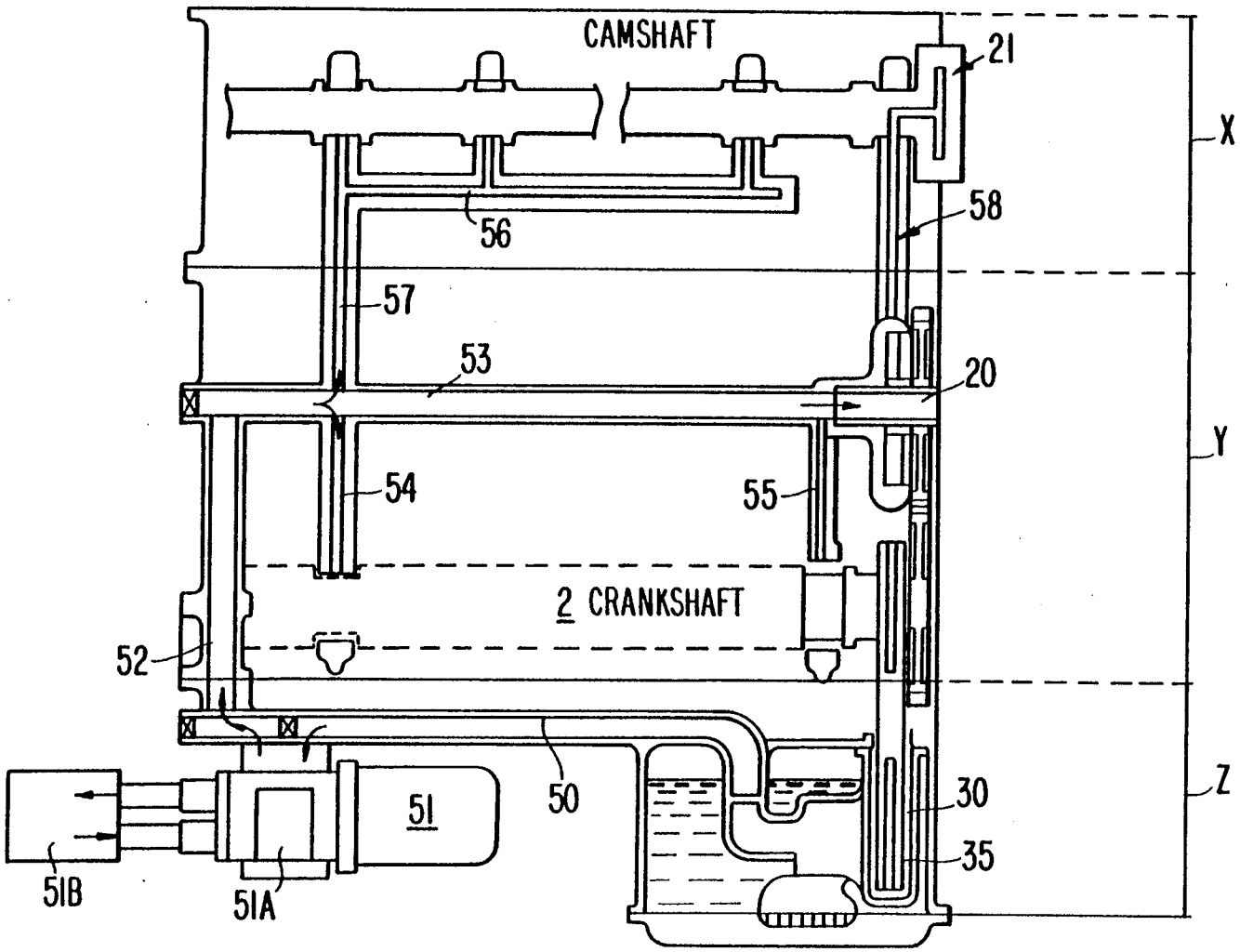
FIG. 4 is a schematic side sectional view of the engine of FIGS. 1–3, depicting the oil circuitry.

FIG. 4 schematically depicts the flow of lubricating oil. Main oil pump 30 supplies oil to line 50 which leads to oil filter 51 and then via line 52 to main gallery line 53 which opens to auxiliary pump 20. A thermostat 51A controls flow of oil coolant fluid to and from oil cooler 51B. Main gallery line 53 also include branches 54 and 55 to the main bearings for the crankshaft 2. Main gallery line also feeds a cylinder head gallery line 56 by way of branch line 57. Oil from auxiliary oil pump 20 is fed to hydraulic camshaft rotating device 21 by way of line 58. Since the pump 20 and line 58 are separated by pump 20 from the main oil circuit 53, 54, 55, 56, 57, this auxiliary oil circuit (20, 58) for the rotating devices 21 can be maintained at the above-described high pressure and small volume.

FIG. 4 also schematically depicts the cylinder-head level "X", the cylinder block level "Y" and the oil pan level "Z" of the overall engine arrangement.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An arrangement for driving two oil pumps arranged on a piston internal-combustion engine of the type having a main oil pump for supplying the engine lubricating-oil circulating system of the internal-combustion engine and a second oil pump, valves of the internal-combustion engine being actuated by camshafts which are driven by a crankshaft, wherein the second oil pump supplies only hydraulic pressure to a hydraulic camshaft rotating device, wherein the main oil pump and the second oil pump are driven by means of respective separate, main and second drives by the crankshaft disposed a the crankcase, and wherein the main and second drives are situated at the same axial location of the crankshaft as a camshaft drive originating from the crankshaft.

2. An arrangement according to claim 1, wherein the main and second drives are situated between a flywheel fastened to the output end of the crankshaft and an end bearing of the crankshaft.

3. An arrangement according to claim 1, wherein the main drive includes a chain for driving the main oil pump, and the second drive includes a gear wheel drive for driving the second oil pump.

4. An arrangement according to claim 3, wherein the second oil pump is coaxially arranged at an intermediate timing gear and is driven by it, the camshafts being driven by the crankshaft by means of the intermediate timing gear.

5. An arrangement according to claim 4, wherein the sprocket wheel driving the main oil pump is constructed in two shells, is radially held together by a retaining ring, is held axially in groove of the crankshaft, and is fixed in the circumferential direction by a fitting sleeve of the crankshaft.

6. An arrangement according to claim 4, wherein the crankshaft gear wheel mates with a gear wheel of the intermediate timing gear, said crankshaft gear wheel being mountable on the crankshaft by being pushed over a smooth turned surface area of the crankshaft until it seats against a retaining ring which holds a sprocket wheel of the main oil pump drive radially together and wherein the crankshaft gear wheel is shrunk onto the crankshaft, when seated in this location.

7. An arrangement according to claim 6, wherein the fitting sleeve for the mounting of the crankshafts wheel for the main oil pump drive is guidable through an end-face bore of the crankshaft.

8. An arrangement according to claim 4, wherein the intermediate timing gear, together with the second oil pump, is disposed on a bearing sleeve fastened in a pump cover, a portion of the lubricating oil delivered by the main oil pump being supplied to the main oil pump by way of the central bore of the bearing sleeve.

9. An arrangement according to claim 1, wherein the oil supply to the second oil pump is by way of a main gallery which also branches off to main bearings of the crankshaft.

10. A method of manufacturing an arrangement for driving two oil pumps arranged on a piston internal-combustion engine of the type having a main oil pump for supplying the engine lubricating-oil circulating system of the internal-combustion engine and a second oil pump, valves of the internal-combustion engine being actuated by camshafts which are driven by a crankshaft, wherein the second oil pump supplies only hydraulic pressure to a hydraulic camshaft rotating device, wherein the main oil pump and the second oil pump are driven by means of respective separate main and second drives by the crankshaft disposed at the crankcase, and wherein the main and second drives are situated at the same axial location of the crankshaft as a camshaft drive originating from the crankshaft.

11. A method according to claim 10, wherein the main and second drives are situated between a flywheel fastened to the output end of the crankshaft and an end bearing of the crankshaft.

12. A method according to claim 10, wherein the main drive includes a chain for driving the main oil pump, and the second drive includes a gear wheel drive for driving the second oil pump.

13. A method according to claim 12, wherein the second oil pump is coaxially arranged at an intermediate timing gear and is driven by it, the camshafts being driven by the crankshaft by means of the intermediate timing gear.

14. A method according to claim 13, wherein the sprocket wheel driving the main oil pump is constructed in two shells, is radially held together by a retaining ring, is held axially in groove of the crankshaft, and is fixed in the circumferential direction by fitting sleeve of the crankshaft.

15. A method according to claim 13, wherein the crankshaft gear wheel mates with a gear wheel of the intermediate timing gear, said crankshaft gear wheel being mountable on the crankshaft by being pushed over a smooth turned surface area of the crankshaft until it seats against a retaining ring which holds a sprocket wheel of the main oil pump drive radially together, and wherein the crankshaft gear wheel is shrunk onto the crankshaft, when seated in this location.

16. A method according to claim 15, wherein the fitting sleeve for the mounting of the crankshafts wheel for the main oil pump drive is guidable through an end-face bore of the crankshaft.

17. A method according to claim 13, wherein the intermediate timing gear, together with the second oil pump, is disposed on a bearing sleeve fastened in a pump cover, a portion of the lubricating oil delivered by the main oil pump being supplied to the main oil pump by way of the central bore of the bearing sleeve.

18. A method according to claim 10, wherein the oil supply to the second oil pump is by way of a main gallery which also branches off to main bearings of the crankshaft.

* * * * *